US005195742A

United States Patent [19]

Bailey

[11] Patent Number: 5,195,742

[45] Date of Patent: Mar. 23, 1993

[54] BASKETBALL HOOP GUARD

[76] Inventor: Kevin N. Bailey, 1694 Rte. 245, Stanley, N.Y. 14561

[21] Appl. No.: 939,162

[22] Filed: Sep. 2, 1992

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 3,181,849 | 5/1965 | Mitchell | 273/1.5 R X |
| 4,082,269 | 4/1978 | Hill | 273/1.5 R |
| 4,805,903 | 2/1989 | McArdle | 273/1.5 R |
| 4,903,964 | 2/1990 | Anderson | 273/1.5 R |
| 5,120,054 | 6/1992 | Wetzel | 273/1.5 R |

*Primary Examiner*—Paul E. Shapiro
*Attorney, Agent, or Firm*—Leon Gilden

[57] ABSTRACT

A basketball hoop guard includes an outer fluid impermeable flexible casing having a shape retentent torroidal polymeric foam core, with the core including a central torroidal cavity for receiving a basketball hoop therewithin. A mounting polymeric foam plate extension is arranged for mounting to the basketball hoop mounting plate for affording protection thereto and to the basketball hoop.

5 Claims, 3 Drawing Sheets

BASKETBALL HOOP GUARD

BACKGROUND OF THE INVENTION

1. Field of the Invention

The field of invention relates to guard structure, and more particularly pertains to a new and improved basketball hoop guard wherein the same is arranged to afford protection to players relative to a basketball hoop and basketball hoop mounting plate.

2. Description of the Prior Art

Guards of various types have been utilized throughout the prior art, wherein in play of basketball, individual contact with a basketball rim results in injury relative to abrasion and the like. The instant invention attempts to overcome deficiencies of the prior art by providing for a guard structure of resilient construction arranged for ease of mounting and securement and maximum protection relative to an individual upon contact with a basketball hoop structure.

Various basketball goal structure has been utilized in the prior art not affording the protection as by the instant invention such as addressed in the U.S. Pat. Nos. 5,066,007; 4,921,248; and 4,082,269.

Accordingly, it may be appreciated there continues to be a need for a new and improved basketball hoop guard as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of guard apparatus now present in the prior art, the present invention provides a basketball hoop guard wherein the same is arranged to coextensively afford protection relative to injury in contact with a basketball hoop and mounting plate structure. As such, the general purpose of the present invention, which will be described subsequently in greater detail, is to provide a new and improved basketball hoop guard which has all the advantages of the prior art guard apparatus and none of the disadvantages.

To attain this, the present invention provides a basketball hoop guard including an outer fluid impermeable flexible casing having shape retentent torroidal polymeric foam core, with the core including a central torroidal cavity for receiving a basketball hoop therewithin. A mounting polymeric foam plate extension is arranged for mounting to the basketball hoop mounting plate for affording protection thereto and to the basketball hoop.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the forgoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved basketball hoop guard which has all the advantages of the prior art basketball apparatus and none of the disadvantages.

It is another object of the present invention to provide a new and improved basketball hoop guard which may be easily and efficiently manufactured and marketed.

It is a further object of the present invention to provide a new and improved basketball hoop guard which is of a durable and reliable construction.

An even further object of the present invention is to provide a new and improved basketball hoop guard which is susceptible of a low cost of manufacture with regard to both materials and labor, and which accordingly is then susceptible of low prices of sale to the consuming public, thereby making such basketball hoop guards economically available to the buying public.

Still yet another object of the present invention is to provide a new and improved basketball hoop guard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
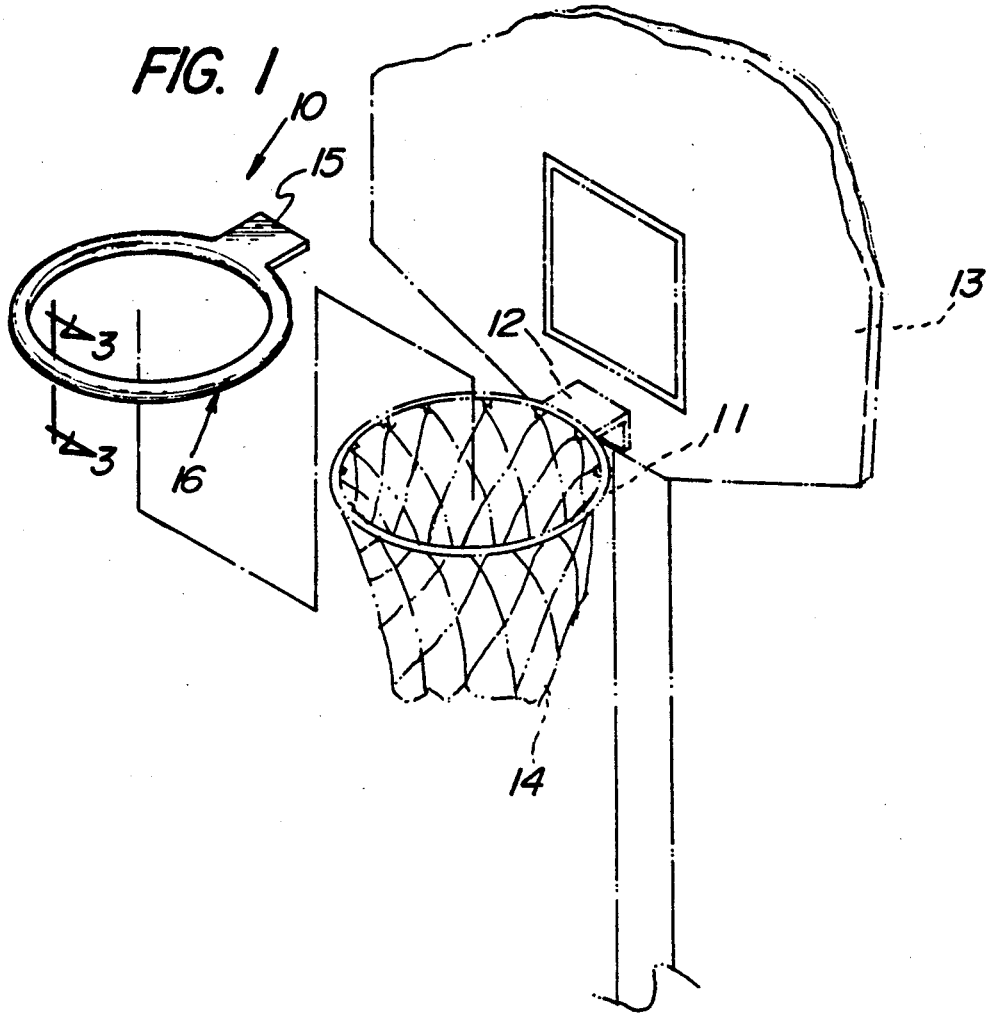
FIG. 1 is an isometric illustration of the instant invention.
Figure 2:
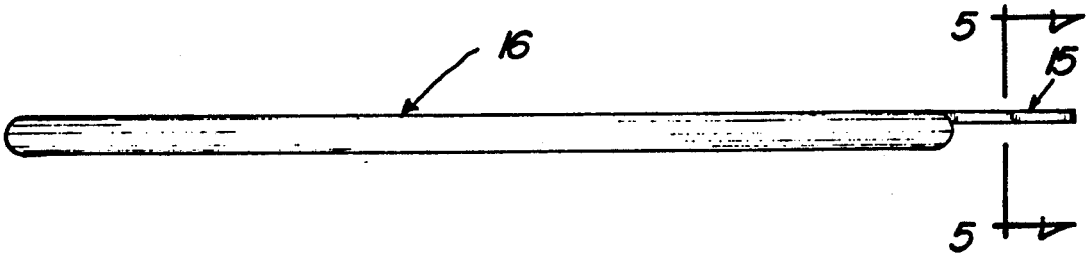
FIG. 2 is an orthographic side view of the instant invention.
Figure 3:
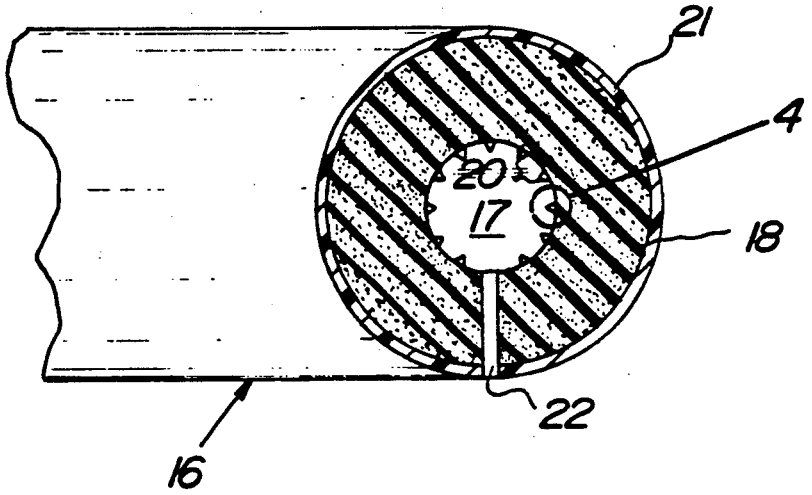
FIG. 3 is an orthographic view, taken along the lines 3—3 of FIG. 1 in the direction indicated by the arrows.
Figure 4:
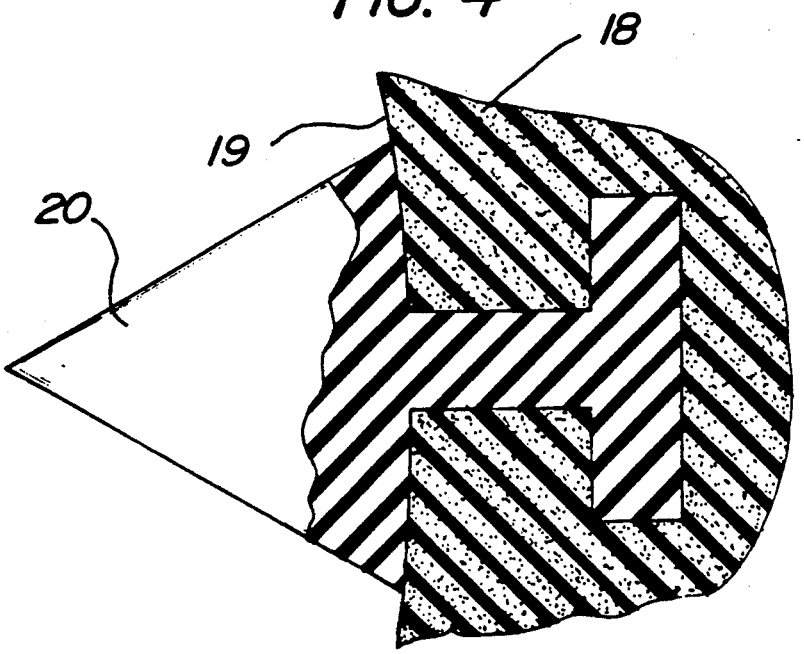
FIG. 4 is an enlarged orthographic view of section 4 as set forth in FIG. 3.
Figure 5:
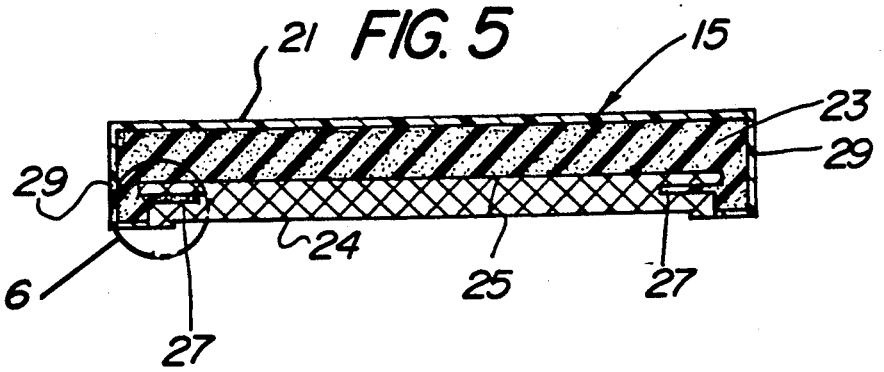
FIG. 5 is an orthographic view, taken along the lines 5—5 of FIG. 2 in the direction indicated by the arrows.
Figure 7:
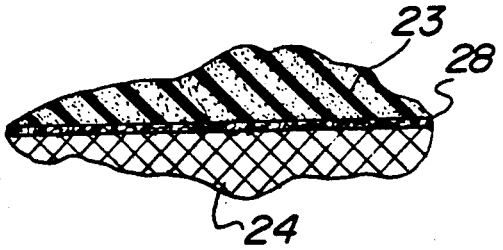
FIG. 7 is an enlarged orthographic view of section 7 as set forth in FIG. 6.
Figure 6:
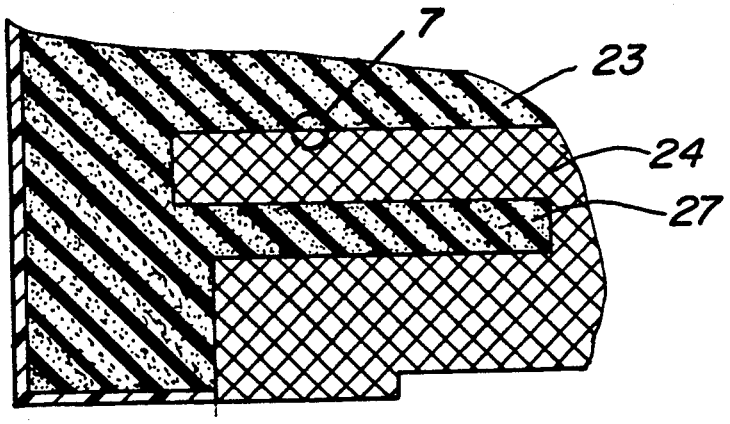
FIG. 6 is an enlarged orthographic view of section 6 as set forth in FIG. 5.

With reference now to the drawings, and in particular to FIGS. 1 to 7 thereof, a new and improved basketball hoop guard embodying the principles and concepts of the present invention and generally designated by the reference numeral 10 will be described.

More specifically, the basketball hoop guard of the instant invention essentially comprises the organization 10 arranged for securement to a basketball hoop 11, having a mounting plate 12 that is in turn orthogonally and fixedly secured to a back board 13. A net assembly 14 projects below the basketball hoop 11 in a conventional manner.

The guard 10 includes a guard mounting web 15 integrally formed to a torroidal ring 16, with the mounting web 15 radially aligned relative to the torroidal ring 16 projecting exteriorly thereof. The torroidal ring 16 includes a central torroidal cavity 17 oriented medially within the torroidal ring 16 surrounded by a torroidal polymeric foam body 18 formed of a resilient shape retentive material. The foam body 19 includes an interior torroidal wall 19 having a matrix of resilient engaging spikes 20 radially directed into the cavity 17 for enhanced engagement with the basketball hoop 11. A flexible covering sheath 21, preferably of a fluid impermeable polymeric material, is arranged in surrounding relationship relative to the foam body 18, with a mounting slot 22 radially directed into the cavity 17, with the slot oriented orthogonally relative to the guard mounting web 15. The mounting slot 22 is coextensive with the torroidal ring 16.

The guard mounting web 15 includes a mounting plate form web 23 having a web top wall spaced from a web bottom wall, with web side walls 29 projecting beyond the web bottom wall orthogonally thereto to define a web recess 25 having a ferromagnet 24 therewithin. The ferromagnet 24 includes an adhesive 28 to secure the magnet 24 to the web floor. The web side walls further include fastening ribs 27 orthogonally oriented relative to the side walls directed into the recess, and more specifically into the ferromagnet 24 to enhance engagement and securement of the ferromagnet relative to the mounting web 15. As in the torroidal ring 16, the covering sheath 21 extends in surrounding relationship relative to the guard mounting web top wall and side walls to afford protection to the mounting plate foam web 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A basketball hoop guard for securement to a basketball hoop and a basketball hoop mounting plate, wherein the guard comprises, a torroidal ring, and the torroidal ring includes a mounting web, wherein the mounting web is radially directed and fixedly secured to the torroidal ring projecting exteriorly of the torroidal ring, with the torroidal ring having a central torroidal cavity, and a torroidal polymeric foam body arranged in surrounding relationship relative to the torroidal cavity of a resilient shape retentive construction, and a fluid impermeable flexible covering sheath arranged in surrounding relationship relative to the foam body, and the foam body including a mounting slot radially directed into the torroidal cavity, with the mounting slot orthogonally oriented relative to the mounting web.

2. A hoop guard as set forth in claim 1 wherein the foam body includes a body interior wall in confronting relationship relative to the torroidal cavity, and the interior wall includes a matrix of resilient engaging spikes radially directed into the cavity for engagement to the basketball hoop.

3. A hoop guard as set forth in claim 2 wherein the mounting plate includes a mounting plate foam web coextensive with the mounting plate, and the foam web having a web top wall spaced from and parallel a web bottom wall, and web side walls orthogonally oriented relative to the web top wall and the web bottom wall extending beyond the web bottom wall, with a recess oriented between the side walls and the bottom wall, with a ferromagnet mounted within the web recess for magnetic adherence to the basketball hoop mounting plate.

4. A hoop guard as set forth in claim 3 wherein the cover sheath is arranged coextensively over the web top wall and the web side walls.

5. A hoop guard as set forth in claim 4 wherein each of the web side walls includes a fastening rib orthogonally oriented relative to each side wall of said side walls and directed into the ferromagnet for securing the ferromagnet within the web recess.

* * * * *